US005382137A

United States Patent [19]

Lane

[11] Patent Number: 5,382,137

[45] Date of Patent: Jan. 17, 1995

[54] MULTIPLE STAGE AIRLIFT PUMP

[76] Inventor: James K. Lane, 116 E. Columbine Rd., Wildwood Crest, N.J. 08260

[21] Appl. No.: 228,195

[22] Filed: Apr. 15, 1994

[51] Int. Cl.[6] ..... F04F 1/18

[52] U.S. Cl. ..... 417/108; 417/109

[58] Field of Search ..... 417/108, 109

[56] References Cited

U.S. PATENT DOCUMENTS

| | | | |
|---|---|---|---|
| 1,339,137 | 5/1920 | Rogers | 417/108 |
| 1,374,952 | 4/1921 | Rogers | 417/109 |
| 1,491,822 | 4/1924 | Rogers | 417/109 |
| 2,744,065 | 5/1956 | Lacey | 417/108 |
| 3,289,609 | 12/1966 | Palo | 417/108 |
| 3,718,407 | 2/1973 | Newbrough | 417/108 |
| 4,671,741 | 6/1987 | Baumberg | 417/108 |

*Primary Examiner*—Richard A. Bertsch
*Assistant Examiner*—M. Kocharov
*Attorney, Agent, or Firm*—Norman E. Lehrer

[57] ABSTRACT

A multiple stage airlift pump apparatus for elevating water or other liquids using only a single air pressure source. The functioning portion of the airlift mechanism is enclosed within a casing which is submerged into a body of water. The casing is connected to a pump via an air line and fitting so that air is forced into the casing and the working portion of the invention. The lift is comprised of a plurality tubular stage members being connected at their upper ends to a nozzle-type member. Each tubular stage member other than the initial one has an inner tubular separating member therein which functions to separate air and water and store the same at the next stage. The inner tubular separating member for each stage member is positioned within the same and is securely connected thereto. The separating members are opened at a lower end which encompasses the nose of the nozzle member and are closed at the upper end. Water is moved upwardly via the air bubbles formed therein, through the nozzles and upwardly into the separating members. Within the separating members, the water is separated from the air and falls downwardly becoming stored in the passageway between the separating member and the tubular stage member. The air pressure builds within the separating members and thereby exits the same, entering the water stored in the passageway. The process then repeats with the air bubbling through the water in the passageway and moving the same upward and into the next nozzle and separating members.

6 Claims, 2 Drawing Sheets

MULTIPLE STAGE AIRLIFT PUMP

BACKGROUND OF THE INVENTION

The present invention is directed toward an airlift pump, and more particularly, to an airlift having multiple stages and using only one air source for elevating liquids.

Multiple stage airlifts have been used to elevate liquids to a higher level by using air pressure. As is well known in the art, air is usually pumped into a lower level of the airlift where the liquid has accumulated and is at rest. A pump is typically provided which pumps air under pressure into the airlift for moving the liquid. From a general standpoint, it is frequently the case in multiple stage airlifts that a plurality of air sources are used so as to initiate the lift at each level. Accordingly, when a lower stage of the airlift moves the liquid up into the next stage, the second source of air pressure takes over and moves the same liquid through that stage and this process continues until the liquid is moved through each stage and to its destination.

There also exist airlifts which use a single source of air pressure at the lowest portion of the multiple stage airlift. With these systems, air is forced into the liquid or the like and the bubbles formed in the liquid tend to move the same upward. At each stage, there usually exists an accumulation device or structure which catches and maintains the water from the lower stage in the second stage. The air from the same source then repeats this process at the next stage. However, these systems require the lift to be submerged a distance equal to the lifting elevation. The prior art discloses both of these types of multiple stage airlifts.

U.S. Pat. No. 1,339,137 to Rogers, for example, discloses an airlift apparatus comprised of an upper and a lower lift connected at a central fluid collection chamber. Fluid is moved via pressurized air bubbling up through the same and carrying it upwardly. Because of slippage and lost work due to the effects of air bubbles increasing in size as they move upwardly, the upper and lower lifts are formed in lengths allowing only minimal loss. Similarly, perforations are formed in the ends of the lifts for maintaining the bubbles in a more productive smaller diameter state. A single source air supply is used which is regenerated in the chamber. Unlike the instant invention, however, the device is limited to raising the fluid a distance equal to the distance that the lower lift is submerged.

U.S. Pat. No. 1,374,952 also to Rogers discloses a different type of multiple stage airlift apparatus. This apparatus includes several cylindrical stages interconnected at their ends by regenerator devices. Each regenerator device functions to change the columns of large bubbles and water into columns of smaller bubbles and water so as to reduce slippage of the air bubbles upwardly in the column and reduce the lost work associated therewith. The regenerator itself does not function to store any of the water at the different stages, it only functions to form smaller bubbles. In addition, the airlift apparatus in Rogers must be submerged a distance equal to the distance of the same above the water. Therefore, the airlift apparatus is limited in its lifting height by the depth of the water.

U.S. Pat. No. 3,718,407 to Newbrough discloses a multi-stage gas lift fluid pump system. The system utilizes high pressure gas delivered from a pump into the submerged end of a cylindrical enclosure. The pumped in gas is used to lift oil from a producing zone within the ground upward and outward into an above ground storage tank. The multi-stage lift is comprised also of supplemental lift devices positioned at intervals along the vertical length of the cylindrical enclosure. Each supplemental lift device includes a check valve which has the effect of reducing the total head of fluid which each section is called upon to lift. The fluid or oil is raised stage by stage until it reaches the surface where it is stored and the gas used to lift the same is removed and used again to lift more of the oil. The supplemental lift devices use a nozzle-type arrangement wherein the gas is forced therethrough creating a Bernoulli effect wherein a low pressure zone is formed above the oil, thereby causing the same to flow upward. The Newbrough device does not use air bubbles for moving the fluid.

SUMMARY OF THE INVENTION

The present invention is directed toward a multi-stage airlift pump apparatus for vertically elevating water or other liquids over a large distance using only a single air source.

The airlift is comprised of an outer casing having an air fitting therein for the introduction of pressurized air which is then directed to an inner cylindrical configuration which comprises the essential elements of the lifting mechanism. The inner cylindrical structure is comprised of a plurality of stages of separable tubing members. Each tubing member has a funnel-shaped nozzle member connected to the upper end thereof through which the air and water travel. Each nozzle member extends into a tubular separating member which functions to trap the pressurized air and separate the liquid from the same. The conically shaped nozzle member functions to prevent any fluid from reentering a preceding stage.

As such, the liquid becomes temporarily stored in a passageway between the tubular stage member and the second tubular separating member. Because the air is continually being forced into the lift, the air pressure builds in the tubular separating member and the air begins to travel out of the same and into the accumulated liquid. This causes air bubbles to bubble up through the same liquid again, thereby moving the same up the passageway to the next stage. Accordingly, the air bubbles lift the water or liquid up the passageway and into the next positioned nozzle member and into the next stage. This process is repeated until the liquid or water is raised to the desired level. Any number of stages can be used so as to accommodate the heights to which the water or other liquid is to be raised.

The airlift is used by placing the same into a well or other liquid reservoir so that the liquid may enter the working portions of the lift. Air is then introduced from a pump or the like into the first tubular stage member and the water is moved upwardly via the air bubbles and through the conically shaped nozzle. As the air pressure builds in the tubular separating member, the air bubbles through the water or other liquid once again and raises the same to the next stage. Accordingly, an airlift mechanism is formed which uses only a single air source for lifting water or liquid to through a number of stages.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
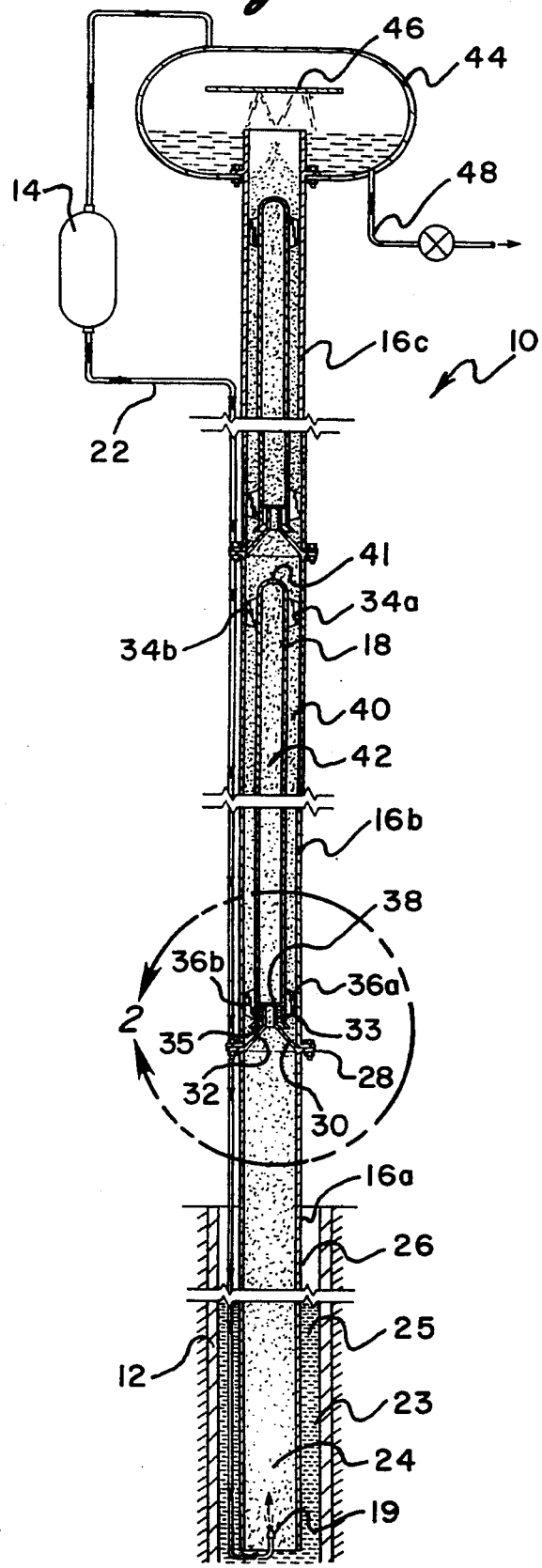
FIG. 1 is an elevational cross-sectional view of an airlift pump constructed in accordance with the principles of the present invention and showing a plurality of stages.
Figure 3:
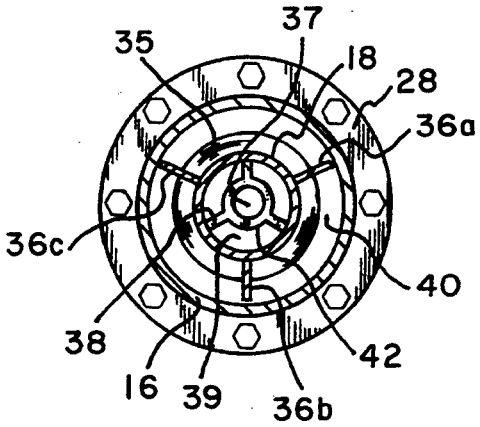
FIG. 3 is a cross sectional view taken along line 3—3 of FIG. 2.

Referring now to the drawings in detail wherein like reference numerals are used throughout the various figures to designate like elements, there is shown in FIG. 1, a cross sectional elevational view of the multiple stage airlift pump constructed according to the invention and designated generally as 10. The airlift pump is comprised essentially of the outer casing 12, the air pump 14, a plurality of elongated tubular stage members designated generally as 16 and a plurality of inner tubular separating members designated generally as 18.

The first stage of the working portion of the multistage airlift is enclosed within the casing 12. The casing 12 can be comprised generally of any large diameter tubing in which the working portion can be fitted. The casing 12 may comprise the existing wall of a well or the like and obviously extends beneath the level 25 of the water or other liquid. The top of the casing 12 may be sealed around the initial tubular stage member **16*a*. Pressurized air from air pump 14 is directed to the bottom of the tubular stages 16 through air line 22 which passes through the space 23 between the casing 12 and the tubular stages 16. Nozzle 19 at the end of the air line 22 directs the air up and into an initial or lower tubular stage member 16*a***.

The water or other liquid 24 in the reservoir or other space 25 enters the casing 12 through the open lower end thereof. The liquid then enters the passageway 23 between the outer casing 12 and the initial tubular stage member **16*a* and also enters the inner portion of the initial tubular stage member 16*a*** so as to allow the air to elevate the same.

The tubular stage members **16*a*–16*c* are all constructed essentially the same. Accordingly, only one tubular storage stage member 16*a*** will be described in detail, it being understood that the description applies equally to each of the other members.

The tubular stage member **16*a* essentially includes a tubular member 26, an upper flange 28 and a nozzle member 30. The tubular member 26 is simply a hollow pipe or the like being of a sufficient length for raising the water or other liquid to the next stage. The tubular member 26 is integrally formed with flange 28 which can be used for connecting the nozzle 30 to the next tubular member and sealing this interface. Alternatively, the nozzle 30 can be integrally formed on the upper end of the tubular member 26. The nozzle 30 is essentially a conically shaped member having the appearance of an inverted funnel wherein the wider portion 32 of the cone shape is connected to the flange 28. The unconnected end of the nozzle member 30 is essentially a cylindrical nipple 33 which extends vertically upward. The conical shape of the nozzle is such so as to direct the liquid or fluid upward with increased force and velocity through the nipple 33. Therefore, upon the application of the air pressure to the water at the base of the airlift, the water bubbles up through the liquid and carries the same upward through the nozzle 30. The water and air mixture is sprayed upwardly through the nozzle and into the next stage which consists of another tubular stage member bolted in an airtight manner to the top of the first stage and which also includes an inner tubular separating member 18*a*** therein.

With the exception of the initial tubular stage member **16*a*, each tubular stage member thereabove has an inner tubular separating member 18 therein. Because there is no need for the deflection of the water and/or fluid and the accumulation of the same in the initial tubular stage member, there is no need for an inner tubular separating member 18**. However, in the subsequent stages, the inner tubular separating member is an essential element of the airlift apparatus.

The inner tubular separating members **18*a* and 18*b* are positioned within their respective tubular stage members, 16*b* and 16*c*, such that they are concentric thereto. The inner tubular separating members extend approximately 90 percent of the length of the tubular stage members and are located within the inner cylindrical opening of each tubular stage member 16. The inner tubular separating members 18 are maintained concentrically in the inner cylindrical opening via fins 34 and 36 extending from the top and bottom, respectively. Plate 38 having an inner opening 37 and openings 39 around the periphery is secured to the inside surface of the member 18 so that the same can rest upon the nipple 33 of the nozzle member 30**.

As with the tubular stage members **16*a*–16*c*, the inner tubular separating members 18*a* and 18*b* are essentially the same. Therefore, only one inner tubular separating member 18*a*** will be described in detail, it being understood that the description applies equally to all separating members.

Figure 2:
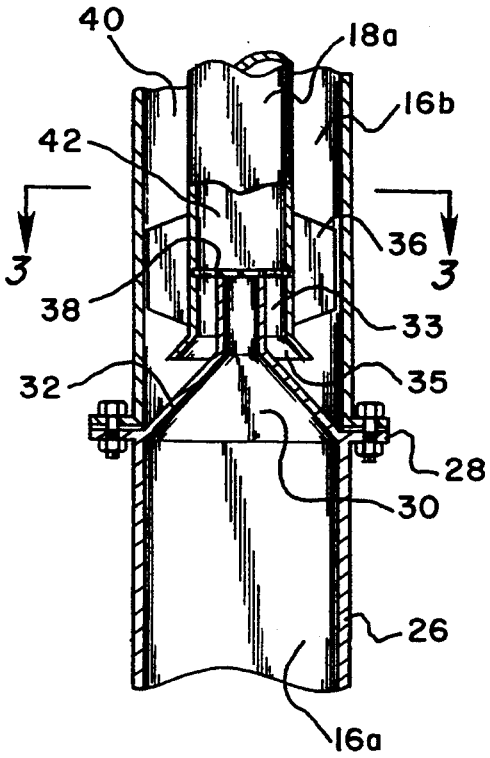
FIG. 2 is an enlarged view of the interface between the separable stages taken along line 2—2 of FIG. 1.
Figure 4:
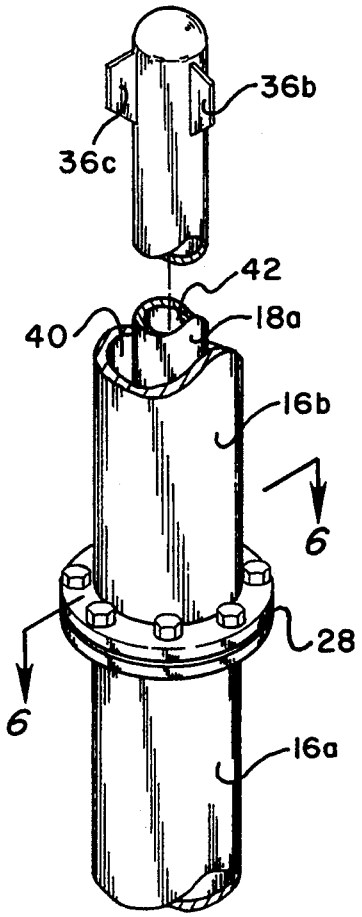
FIG. 4 is a cut away view of a separating member positioned within a tubular member.
Figure 5:
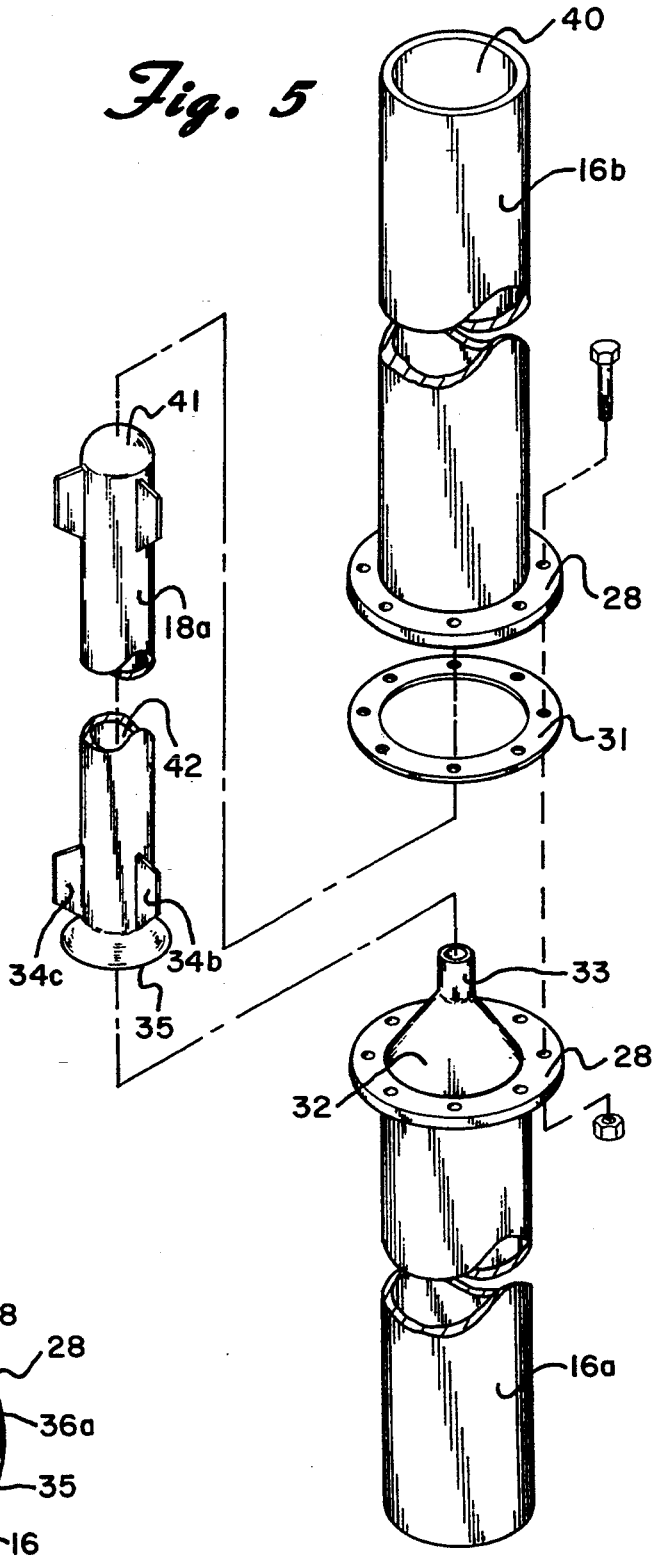
FIG. 5 is an exploded view of the interface between the stages of the airlift.
Figure 6:
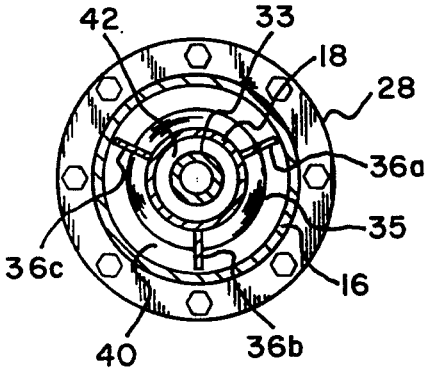
FIG. 6 is a cross sectional view taken along line 6—6 of FIG. 4.

Referring now to FIGS. 1, 2 and 5, the inner tubular separating member **18*a* is again essentially a tubular member having a smaller outside diameter than the tubular stage member 16*b* in which it is located. The inner tubular separating member 18*a* is positioned, with respect to the nozzle member of the lower tubular stage member such that the cylindrically shaped nipple 33 of the nozzle member 30 extends into the lower portion of the inner tubular separating member 18*a* and the plate 38 rests on the nipple 33. The plate 38 has holes 39 therein for allowing the passage of air and water to the separating member. The lower portion 35 of the inner tubular separating member is open while the upper portion 41** is closed.

As discussed, the inner tubular separating members are securely maintained in the tubular stage members via fins **34*a*, 34*b* and 34*c* and the fins 36*a*, 36*b* and 36*c* located on the upper and lower portions, respectively, of the inner tubular separating member 18*a*. The nozzle member 30 of the preceding tubular stage member 16*a* extends into the lower portion 35 of the inner tubular separating member such that the cylindrical nipple 33 thereof is completely encased by the inner tubular separating member 18***a*. The lower portion 35 of the inner tubular separating member is flared outwardly, extending substantially parallel to the conical sides of the nozzle member 30. This flare-out effect of the lower portion 35 allows the water to flow from within the inner tubular separating member 18*a*, out the same and freely around the inwardly extending nozzle member 30.

A second passageway 40 is formed between the inner tubular separating member 18*a* and the tubular stage member 16*b*. The water being moved and forced upward accumulates within the passageway 40 until the air pressure builds enough to push the same upward and into the next nozzle and stage. Accordingly, the water or fluid is moved upwardly through the initial tubular stage member 16*a* and into the tubular separating member 18*a*. The water sprays into the separating member 18*a* and falls downwardly into the passageway 40. While the water builds up in passageway 40, the air pressure builds in the cylindrical opening 42 of the separating member 18*a*. As the pressure builds, the air begins to force downward and out through the bottom 35 of the separating member 18*a* and out of the same around the conically shaped nozzle 30. The air begins to bubble up again through the water stored in the passageway 40 and the process repeats thereby forcing the water upwardly with the bubbles and out through the next nozzle member. This forcing process repeats until the water is moved to the very top of the lifting mechanism.

As shown in FIG. 1, at the very top of the airlift pump, the water enters an enclosure 44 having a baffle 46 and is moved via piping 48 or the like to a useful destination. The storage facility 44 has a valve thereon for the release of the water for whatever use it is intended. Furthermore, air in the upper part of the enclosure 44 is delivered back to the air pump 14.

The multiple stage airlift apparatus is used by submerging the same in a body of water or other fluid. Unlike previously proposed devices, the airlift pump apparatus does not have to be submerged a distance equal to the distance in which the water is to be elevated. Upon submersion of the airlift apparatus, the pump 14 can be turned on so as to initiate the influx of air into the apparatus. Accordingly, and as discussed, the air bubbles up through the water in the initial lower portion of the airlift and moves the water upwardly into the first nozzle 30. As the air pressure builds and the air continues to move upwardly with the water, it is moved into and out of the nozzle 30 and into the first inner tubular separating member 18*a* wherein the water falls and collects in the passageway 40 surrounding the inner tubular separating member 18*a*. As the water accumulates in the passageway, the air pressure is building in the separating member 18 and begins to force the water in the passageway 40 upward and into the next nozzle member via the bubbling activity. This process is repeated at each stage until the water is moved to the height desired. The water is then discharged into a storage facility 44 as discussed.

The present invention may be embodied in other specific forms without departing from the spirit or essential attributes thereof and accordingly reference should be made to the appended claims rather than to the foregoing specification as indicating the scope of the invention.

I claim:

1. A multiple stage airlift for elevating liquids, comprising:

a lower elongated member means having means for receiving air adjacent the bottom thereof, said air being adapted to move liquid upwardly through said airlift;

at least one additional elongated member means arranged end to end above said lower member means and being connected thereto;

each of said elongated member means having a nozzle means connected to and extending from an upper end thereof, at least one of said nozzle means extending into a next consecutively positioned elongated member means;

at least one of said elongated member means having an elongated separating means extending upwardly therein and forming a passageway between said elongated member means and said separating means for the passage of said liquid and air, said separating means including a cylindrically shaped member having a sealed end and an open end, said open end being flared outwardly for receiving said nozzle means, said separating means being adapted to receive said air and liquid from said nozzle means and being adapted to separate said liquid and air and deflect said liquid downwardly and into said passageway, and said air becoming pressurized in said separating means, thereby causing said air to escape from said separating means and bubble up through said liquid in said passageway carrying the same upwardly through said elongated member means.

2. The invention according to claim 1 wherein said air is adapted to move said liquid through said passageway and into an additional nozzle means and separating means and irreversibly into a next passageway until said liquid is moved upwardly and through said airlift.

3. The invention according to claim 1 wherein said elongated member means comprises a tubularly shaped member means.

4. The invention according to claim 1 wherein said separating means includes fins extending therefrom for securely maintaining said separating means within said tubularly shaded member means.

5. The invention according to claim 1 wherein said nozzle means comprises a conically shaped member having a cylindrical section extending therefrom, said cylindrical section extending into said separating means.

6. The invention according to claim 1 wherein said elongated member means are connected together via flange means.

* * * * *